US005577780A

United States Patent [19]

Justice

[11] Patent Number: 5,577,780

[45] Date of Patent: Nov. 26, 1996

[54] PUSH/PULL LATCH ASSEMBLY

[76] Inventor: Terry Justice, 318 Tulip Oak Ct., Linthicum, Md. 21090

[21] Appl. No.: 507,645

[22] Filed: Jul. 25, 1995

[51] Int. Cl.[6] ..... E05C 1/12

[52] U.S. Cl. ..... 292/170; 292/169.18; 292/358

[58] Field of Search ..... 292/169, 165, 292/170, 336.5, 358, DIG. 52, 169.14, 169.15, 169.18

[56] References Cited

U.S. PATENT DOCUMENTS

| | | | |
|---|---|---|---|
| 455,334 | 7/1891 | Iske et al. . | |
| 2,131,458 | 9/1938 | Turner . | |
| 2,939,737 | 6/1960 | Nygren | 292/170 |
| 3,020,073 | 2/1962 | Williams | 292/336.5 X |
| 5,157,953 | 10/1992 | Hung | 292/170 X |

*Primary Examiner*—Rodney M. Lindsey
*Attorney, Agent, or Firm*—Peter Gibson

[57] ABSTRACT

A latch assembly is operated by either pushing or pulling against the end of, displacing a given amount of longitudinal travel, a spindle which has a helically formed portion of a given length engaged by congruently formed cam aperture surfaces. The cam is rotatably positioned with respect to and in engagement with the spindle. A rollback is contacted by one of two lobe surfaces of the cam, one corresponding to a pull of the spindle, the other corresponding to a push upon the spindle from the opposed end, the cam rotating in alternate directions. The rollback may be of a single piece with the latch member which is slidably held by the frame of the latch assembly. Biasing of the latch into an extended position and limiting the travel allowed the spindle with positive stops along with biasing of the spindle is suggested such that the normal, extended latch position has one spindle end which may only be pushed against the biasing through the given amount of travel, thus effecting unfastening of the closure and facilitating opening of the closure as well with a single motion; the opposed spindle end may only be pulled, against the same bias, through the travel and similarly effect unfastening and opening of the closure with a single motion. Locking of the assembly is suggested, preferably by disengagement of the rollback from the cam as opposed to interposition of a member inhibiting spindle travel.

20 Claims, 4 Drawing Sheets

15
13
12
71
11
51
62
2
50
20
30
40
10
70

28
24
26
23
25
29
20

40
51
29
20
21
28
32
30
62
50

PUSH/PULL LATCH ASSEMBLY

BACKGROUND OF THE INVENTION

1. Field of the Invention

The general field of the present invention is concerned with closure fasteners of the type commonly known as latch assemblies wherein the latch, possessing an angled face with respect to the catch disposed within the jamb is normally biased into an extended position whereby fastening of the closure is effected when closure and jamb are fully aligned. More particularly, the field of the present invention relates to such door latches operated by longitudinal displacement of a spindle having a knob attached to either end and specifically to those utilizing a cam possessing a formed aperture engaging a helically formed portion of the spindle which, by rotation in reaction to said longitudinal displacement of said spindle causes lateral displacement of the rollback thereby effecting retraction of the latch.

2. General Background of the Invention

Latch assemblies, such as those typically employed for the fastening of a common door, are characterized by a sliding latch possessing an extended face angled with respect to a catch disposed in a jamb whereby contact between the two retracts the latch, as commonly effected in closing a door, the latch extending into a cavity of the catch when fully aligned with the jamb. Such devices are further typically characterized by biasing of said latch by means of a spring; leaf, coil or other type into the extended position and possess mechanical means for retraction of said latch typically including a rollback, a spindle and a handle. Torque is exerted upon said spindle by rotational displacement of said handle thereby effecting rotation of said rollback which translates said torque into a lateral displacement, normal to said spindle, of said latch in an inward direction thereby retracting the latch and unfastening the closure.

Fundamentally, such latch assemblies enable retraction of the latch in a linear displacement which is perpendicular to a spindle to the end of which a knob or handle is attached to facilitate the application of torque upon the spindle. The application of torque hence requires exertion of force in a direction within a plane parallel to the closure. In the case of a door, it is usually desired to unfasten the closure in order to pass through a doorway. If one's hands are otherwise occupied carrying something bulky, one or more containers, or when carrying a plurality of loose objects, such as groceries for example, it is often inconvenient if not impractical for one to free a hand in order to turn the door knob as described above as required to egress through the doorway.

Therefore it is considered desirable to effect retraction of a latch of the type commonly employed to fasten doors or other closures with exertion of a force in a direction consistent with the general movement through the doorway which is normal to the face of the closure. In closures disposed to open in one direction, either inward or outward with respect to the orientation of the enclosure concerned, it is desirable to open a door either by pushing (exertion of compressive force in a direction substantially normal to the face of the closure) if the door opens outward, or by pulling (exertion of tensile force in said direction substantially normal to the face of the closure) if the door opens inward. Either action enables both unfastening and opening of the closure with a simple force applied in one direction, ie. operation with a single motion, which is recognized as inherently easier than any requiring more than a single motion such as that required by closures having a conventional latch assembly requiring rotation of the spindle prior to displacement of the closure itself.

Discussion of the Prior Art

The desirability of effecting unfastening and opening of a common door with single motion, either pushing or pulling, and the relative ease of operation in unfastening a latch with either a push or pull rather than rotation of a handle or knob has been recognized for over one hundred years, at minimum. U.S. Pat. No. 455,334 issued Jul. 7, 1981 to Anthony & Albert Iske for a 'Latch' discloses an early example of such and U.S. Pat. No. 2,131,458 issued Sep. 27, 1938 to R. M. Turner discloses another example of the same. Both are essentially similar in using a cam operated rollback where the cam engages a helically formed spindle. The latter utilizes a pivoted handle attached to either end of the spindle, instead of the simple knob disclosed in the earlier patent and further recommends specific construction of the cam and rollback from relatively thin, formed bar and stamped components in comparison with the typically square spindle and presumably cast rollback of the earlier disclosure of A. & A. Iske.

Reflection upon the operation of the relatively thin cross sectional area of what may be considered the critical components, the spindle and cam, of the latter may point out an inherent difficulty in the operation of the former, this difficulty being ameliorated with said relatively thin cross sectional components. The Iske disclosure utilizes a typical, square spindle twisted ninety degrees and a cam, termed a "hub", possessing a square central aperture through which said spindle passes. It is observed, however, that while a cam possessing a square aperture closely fit to the square cross section of the straight portion of the spindle slides smoothly and with substantial surface contact along this section, the length of the two opposed pairs of parallel, apposed, flat faces comprising the aperture corresponding to the width of the cam, each of which may contact the nominally square perimeter of the spindle, serves to prohibit travel of the same along a twisted portion of the same spindle.

For, while any given cross section through the twisted portion of the spindle may be square, the same as one taken along a straight portion, this is a frame taken from a continuously rotating succession of such frames, each a plane, of only two dimensions. The third dimension, length, must be considered. A square aperture having flat faces given any significant width cannot accommodate the helical topography of the twisted spindle portion unless the square aperture is so large that only the edges of the helical portion of the spindle contact the sides of the aperture.

This inherent problem is minimized in the invention disclosed by Turner in utilizing a relatively thin cross sectional configuration for both the spindle, which is given one hundred eighty degrees of rotation, and the cam, which possesses a substantially rectangular aperture of relatively thin width. Thus the binding associated with the mechanism disclosed by A. & A. Iske is avoided in minimizing the length of the contact between the helical spindle surfaces and the flat internal surfaces comprising the aperture of the cam. In reducing the area of contact surface, however, the wear expected upon these critical components is exacerbated.

Statement of Need

It is therefore considered that a need exists for a longitudinally displaced spindle cam operated mechanism in a latch assembly which will provide for substantial surface contact between the helical topography of the spindle and the internal surfaces comprises the cam aperture engaged while avoiding the binding associated with flat cam aperture surfaces.

SUMMARY OF THE INVENTION

Objects of the Present Invention

The encompassing object of the present invention is the retraction of a latch laterally with respect to a spindle by longitudinal displacement of said spindle via a mechanism, herein known as a push/pull latch assembly, which relies upon contact between topographically congruent surfaces in the mechanical, directional, translation of force applied upon said spindle causing the rotation of a cam in operation of said mechanism.

A corollary objective of the present invention is a push/pull latch assembly which avoids the contact of an edge against a surface in the mechanical translation of force applied upon said spindle in the operation of said mechanism thereby minimizing wear between contacting components further facilitating effective transmittal of force thereby providing for a mechanism of superior reliability.

An ancillary objective of the present invention is a push/pull latch assembly requiring a minimum of moving components, thereby facilitating both reliability in operation and economic manufacture.

Another objective of the present invention is a push/pull latch assembly which, properly installed in a hinged door, allows unfastening of the latch and opening of the door with a single motion from either side of said door.

An auxiliary objective of the present invention is the provision for locking of a push/pull latch assembly, preferably by disengagement of two components necessarily contacting one another to effect retraction of said latch.

The above stated objects of the present invention and other related objectives and benefits which will become apparent in the detailed description of the invention following may be realized through adherence to the principles relating to said invention which are outlined directly below.

Principles Relating to the Present Invention

A push/pull latch assembly utilizes a spindle possessing a helix, ie. a helically formed exterior portion, a cam engaging the same, a rollback and a latch held in a frame to maintain each component in operable engagement with each other. The rollback and latch may further be combined in a single piece. It is recommended that the latch be biased in an extended position by some spring means, including but not restricted to coil and leaf and also that the spindle be similarly, but separately, biased.

The latch, normally extended, is retracted by displacement of the rollback effected via contact with a lobe surface of the cam effected by rotation of the cam. The cam, rotatably disposed with respect to and in engagement with said spindle helix, is rotated by longitudinal displacement, ie. travel, of the spindle about a central axis of a cam through aperture that is comprised of arcuate surfaces congruent to the arcuate spindle helix surfaces. Substantial surface contact between said helix surfaces and congruent cam aperture surface enables the transfer of a relatively substantial amount of force without deformation, thereby facilitating the manufacture of a relatively durable and effective push/pull latch assembly in fulfillment of the above stated objectives. Locking of said latch in the extended position is also suggested, particularly by displacing the rollback with respect to the cam lobes surface contacting the same and by impeding spindle travel.

Travel may be limited by positive stops and the spindle biased such that when the latch is extended, one spindle end is biased outward and the opposed end is biased inward. Hence unfastening and opening of the closure to which said latch assembly is installed may be effected with a single motion, pushing or pulling. It is further suggested that a knob be fixedly attached to one spindle end an that the other, free end, be threaded and a second knob correspondingly tapped; that a cover plate on either side of the closure have a cylindrical extension, ie. sleeve, overlapping a sleeve of the knob; and that the spring means biasing the spindle be enclosed in the overlapping sleeves associated with the tapped knob on the interior side of the closure.

Installation in a conventional door may then be effected by inserting the frame with the cam, rollback and latch into the cavity in the edge of the door, fastening the same, then inserting the free end of the spindle through the cam aperture, rotating the helix. It is suggested that at least one bolt be passed through an aperture in the interior cover plate and threaded into a tapped aperture in a structure connected with the frame to stabilize the same. Variation in door width is accommodated by two factors: the length of the helix in excess of the travel, and the length of threading on the free end of the spindle. The entire assembly, including the two cover plates, is pulled together by screwing the tapped knob onto the threaded end of the spindle and is complete when the bias given the spindle by said spring means resists this action.

It is also considered desirable to employ a means of prohibiting rotation in the spindle after the helix has been passed through the cam aperture in installation, especially in the case wherein a tapped knob and threaded spindle end is utilized. More particularly, it is recommended that a length of the spindle adjacent the threaded end be given at least one pair of opposed flats and that this length of spindle be disposed through a length of a congruent aperture in the hardware associated with the push/pull latch assembly. It is further recommended that such a member be comprised of an externally splined bushing and that the central bore of the interior cover plate be given an internal splining congruent to that of the bushing.

These principles may be better understood and appreciated with what is considered to be the best manner of making and utilizing an embodiment of said principles, with a reading of the detailed description below with reference to the drawings attached hereto and briefly described directly below.

DETAILED DESCRIPTION OF THE INVENTION

Figure 1:
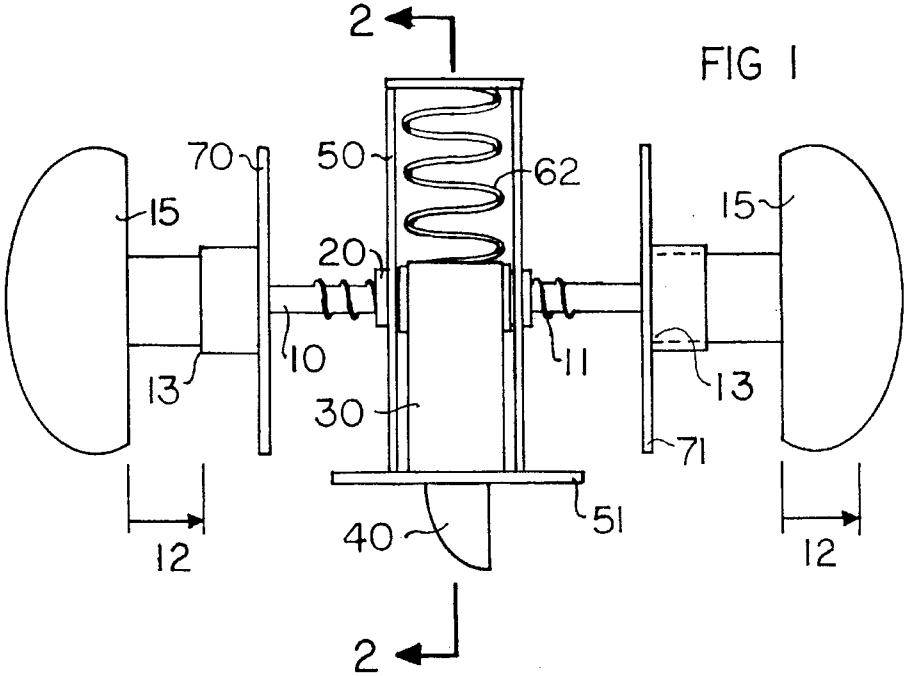
FIG. 1 is a plan elevational view taken from the top of a push/pull latch assembly in accordance with the principles relating the present invention.

As seen in FIG. 1, a spindle 10 possesses a helically formed portion, ie. a helix 11, and possesses a predetermined, ie. given, amount, of longitudinal displacement, ie. travel 12 which is determined by at least one positive stop 13. At each end of the spindle 10 is attached a knob 15 upon which a compressive force, ie. push, or a tensile force, ie. pull, is applied in order to displace the spindle 10 and the helix 11 through the travel 12 which, by rotating a cam 20 and thus displacing a rollback 30, effects retraction of a latch 40, which, as depicted in FIG. 1, is typically biased by some spring means such as the coil spring 62 illustrated into the extended or normal position.

Figure 2:
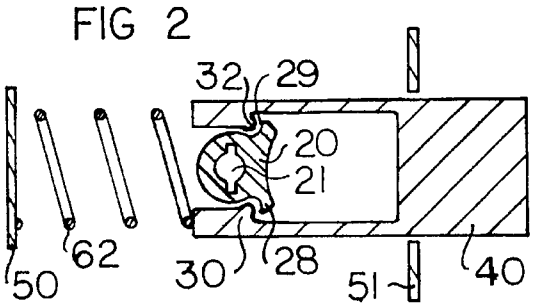
FIG. 2 is a cross sectional view taken from FIG. 1 illustrating the operation of a combined latch/rollback with the cam.

As seen in FIG. 2, a cam 20 is disposed to displace a rollback 30 which is integral to the latch 40 when rotated. A cam in accordance with the principles relating to the present invention possesses a cam aperture 21 that possesses surfaces which are congruent to surfaces of the helix 11 upon the spindle 10 and which rotates in reaction to spindle travel 12. The helix 11 depicted in FIG. 1 is a spiral, with substantially uniform thickness, raised from the root diameter of the spindle 10. The cam aperture 21, therefore, as more clearly seen in FIG. 3, possesses an opposed pair of helical grooves 24 and a base diameter 26 which corresponds to the helix 11 and the root diameter of the spindle 10. The cam 20 is held longitudinally stationary by the frame 50 seen in FIG. 1, allowing the cam to rotate about the longitudinal axis of the spindle 10 in reaction to spindle travel 12.

Figure 3:
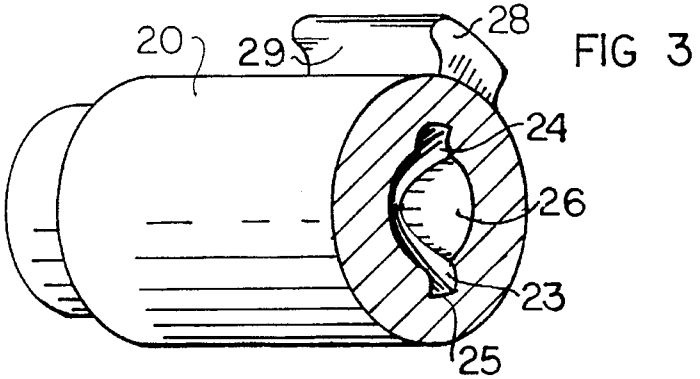
FIG. 3 is an isometric view of a cam similar to that depicted in FIG. 2 but having only one lobe.

The cam 20 depicted in FIG. 3 displays only one lobe 28, in contrast to the two depicted in FIG. 2. This enables operation from one side of the closure only, such as is desired in an emergency or fire exit as such doors are commonly known. Two lobes 28 are required for push and pull operation as illustrated in FIG. 1. The ability of the cam 20 to be rotated by spindle travel 12, without binding, is dependent upon the aperture 21 of the cam 20 comprising arcuate surfaces 23–26, seen in FIG. 3, being congruent to the form comprising the helix 11.

The helix 11 might alternately be comprised of a groove; adherence to the principles relating to the present invention requires a helical form comprising the juxtaposition of negative and positive space divided and defined by surfaces which are inherently arcuate both radially and axially. A groove is therefore functionally equivalent to the spiral raised from the root diameter depicted in the drawings attached hereto. If a helical groove were cut into the spindle 10, the cam aperture 21 with congruent interior surfaces would resemble that depicted in FIG. 9. As seen in FIG. 3, the interior surfaces 23–26 of the cam 20 define two helical grooves which bisect the cam aperture 21 and which divides the otherwise smooth bore 26.

In manufacture, it is considered best to take a cylindrical blank possessing a bore corresponding to the base bore 25 of the cam aperture 21 depicted in FIG. 3 and then broach the two opposed grooves with a tool possessing a cutting edge defined by a cross section of the cam aperture 21 while rotating either the tool or the cam blank during the broach. This suggested manner of manufacture illustrate the aspect of the internal surfaces of a cam aperture 21 discussed above. A form congruent to a helix of significant thickness or width is necessarily comprised of surfaces which are both radially and axially arcuate with respect to the longitudinal axis of the helix or spiral. As depicted in FIG. 3, one side of one helical groove is convex with respect to a radius and one is concave. This is not necessarily evident in cross section, the convex and concave surfaces depicted are meant to be representative of this physical attribute.

Topographical congruence between the helical spindle surfaces and the surfaces defining the cam aperture 21 achieves surface to surface contact between the two without binding and enables effective transmittal of force from one to the other while avoiding excessive wear in operation as no edge to surface contact between components of the assembly is necessary. In short, in order to provide a reliable push/pull latch assembly for the purposes outlined herein, topographically congruent surfaces between the helically formed portion 11 of the spindle 10 and the interior surfaces 23–26 of the aperture of the cam 20 are required.

Figure 7:
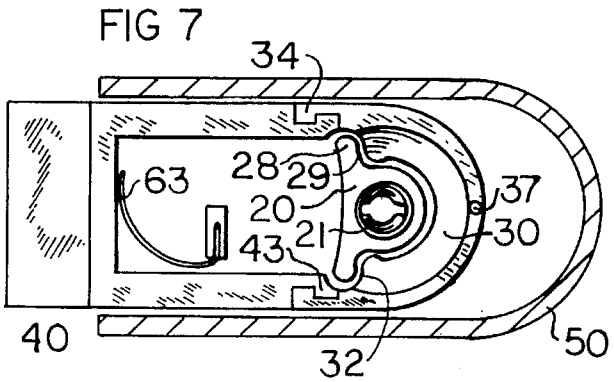
FIG. 7 is an elevational view of the interior of a push/pull latch assembly in accordance with the principles relating to the present invention taken from the side of the assembly depicting separate rollback and latch elements.

Similarly, it is desirable that all contact between moving components be between congruent surfaces in order to avoid excessive wear and achieve good reliability and that all such contact be substantial with respect to the forces expected. Contact between the cam 20 and the rollback 30, as seen in FIG. 2 and more clearly in FIG. 7, is between convex contact surfaces 29 of the lobes 28 and a concave contact surface 32 of the rollback 30 as the cam 20 rotates in order to displace the rollback 30. This construction, though recommended, is not necessary to fulfillment of the principles relating to the present invention; a link arm pivoted at either end with a cam lobe 28 and the rollback 30 would suffice to effect the required displacement, for example, and other means may be readily substituted. The addition of any moving components is simply considered undesirable.

It is not necessary for the fulfillment of the principles relating to the present invention that the latch assembly possess spring means for basing the latch 40 into the extended position. Were the cam 20 connected by means of two link arms to the rollback 30, as given as an example above, it is readily seen that the spring means acting upon each knob 15 would maintain the latch 40 in an extended position. Furthermore, the spring means biasing the latch 40 in an extended position would also maintain the spindle 10 in a given longitudinal position without spring means acting upon with knob 15 were the cam 20 and rollback 30 rigidly connected, as in the case of one or two link arms mentioned twice above as an alternate example. It is necessary, with regard to fulfillment of the principles relating to the present invention, that the latch 40 be fully retractable by rotation of the cam 20 effected by spindle 10 travel. Fully retractable is understood to mean sufficiently retracted for the latch 40 to clear the catch into which extension of the latch 40 effects fastening of the closure to which the latch assembly is installed. In practice, this normally means retracted within the frame 50 of the latch assembly or substantially flush with the surface of the frame 50 facing the catch when the closure is aligned with the jamb.

In order for the latch 40 to be so fully retracted, several component displacements, must be achieved. In reverse order: sufficient travel within the frame 50, must be provided for full retraction of the latch 40 and rollback 30; the cam lobes 28 must be sufficiently long in radial extension and the cam 20 must possess sufficient rotation, in combination, to provide sufficient 'throw' against the rollback 30; the internal threading of the cam aperture 21 must be sufficient to provide adequate rotation; the length of the helix 11 of the spindle 10 must be sufficient to effect the rotation and the spindle travel 12 must be sufficient to provide an adequate length of engagement of the helix 11 with the congruently formed cam aperture 21.

Another aspect relevant to the principles relating to the present invention concerns the pitch given to both the helix 11 and the congruent cam aperture 21. In order for sufficient surface to surface contact between the two to exist and for said contact to effectively transfer the forces involved, it is necessary that said pitch given each component to be quite gradual relative to typical screws and nuts which, also, are not arcuately shaped with regard to the longitudinal axis. It is desirable to give the helix 11 and the congruent cam aperture 21 a 'pitch' of one or less turns per diameter, preferably one half turns per diameter or less. Pitch in the United States is typically expressed in threads per inch, TPI, which for present purposes is related to root diameter for comparison. Utilizing for exemplary purposes, a root diameter of one quarter inch (0.250") one typically finds a unified coarse, (UNC), pitch of twenty, (20 TPI), which divided by the nominal root diameter yields eighty (80) turns per diameter of length.

Figure 4:
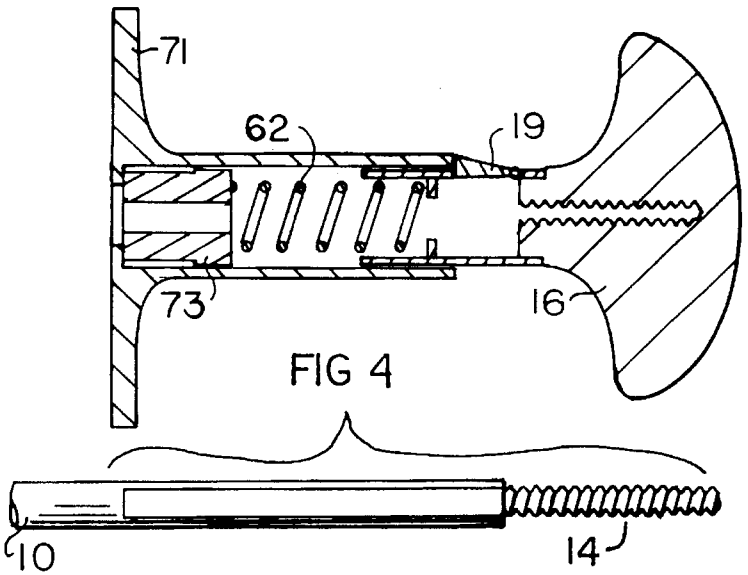
FIG. 4 is a cross sectional view of a push/pull latch assembly in accordance with the principles relating to the present invention taken from a side and a plain elevational view of a threaded spindle end.
Figure 5:
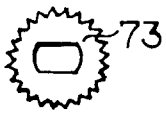
FIG. 5 is a plain elevational view taken from the top of a splined bushing.
Figure 6:
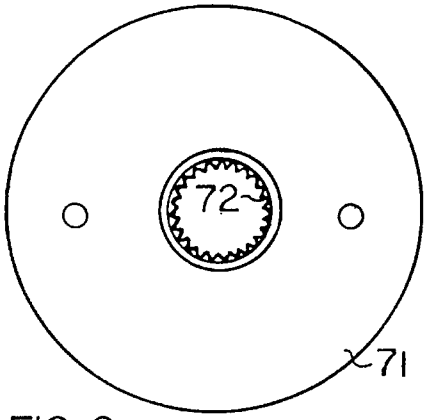
FIG. 6 is a plain elevational view taken from the top of a cover plate with a splined bore.
Figure 8:
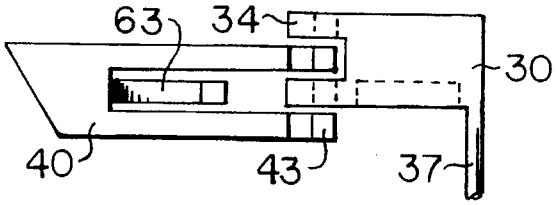
FIG. 8 is a plain elevation taken from the top of the rollback and latch depicted in FIG. 7 illustrating lateral displacement of the rollback relative to the latch.

FIG. 4 depicts a means of locking the latch 40 in the extended position comprising the interposition of a member shown as a pawl 19 which prevents the sleeve extending from the knob 16 from sliding into the sleeve extending from the cover plate 71. Since the knob is fastened to the end of the spindle 10 its travel 12 is thereby prevented. Another means of locking the latch 40 is depicted in FIGS. 7 & 8 as discussed below. FIGS. 4–6 demonstrate that a push/pull latch assembly allows the threading of a tapped knob 16 upon a threaded free end 14 of the spindle 10 and that a given rotational orientation may be fixed by some means, exemplified by the use of a splined bushing 73 having an aperture congruent to the cross section of a length of the spindle 10 given a pair of opposed flats.

Figure 10:
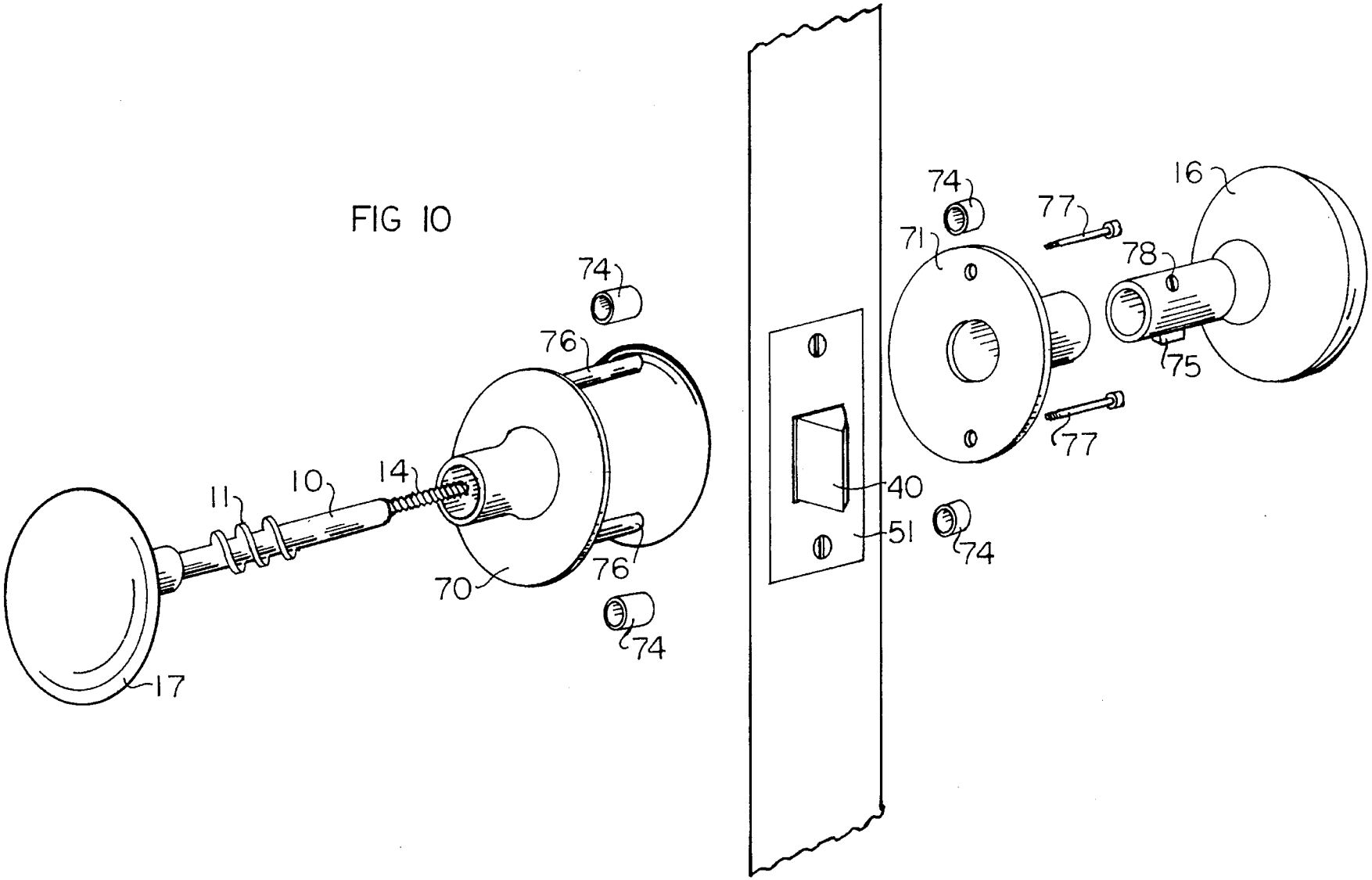
FIG. 10 is an explosion view illustrating the assembly of a spindle fixed to one knob with one free end threaded, the opposed cover plates, a tapped knob and attachment to a door in which a latch assembly such as that depicted in FIG. 9 has first been located within a door.

These attributes are discussed in further detail below in connection with installation of a push/pull latch assembly and the associated hardware upon a conventional door. Another example is depicted in FIG. 10 wherein the sleeves extending from the interior cover plate 71 and the interior knob 16 are given congruently apposed longitudinal features which allow the sleeves to slide one within the other but prevent rotation. The sleeve extending from the knob 16 possesses a key 75 which slides into an internal slot or keyway effected in the interior of the sleeve extending from the cover plate 71. The threaded spindle end 14 depicted, if used with a tapped knob 16 will not permit use of this means of fixing the rotational orientation of the spindle 10, an unthreaded knob would be required. The sleeve extending from the knob 16 also has a set screw 78 to fasten against the spindle 10, thus preventing rotation of the knob.

FIGS. 7 & 8 depict a latch assembly in accordance with the principles relation to the present invention in the normal or rest position with the latch 40 and rollback 30 as a separate components and the spring means biasing the latch 40 into the extended position is a leaf spring 63. By separating the rollback 30 and latch 40, the two may be disengaged which in effect locks the latch 40 in the extended position. As seen in FIG. 7, the latch 40 possesses a pair of hooks 43 which laterally interlock with a congruent pair of rollback hooks 34. This is exemplary of the tensile connection between the two necessary to achieve retraction of the latch 40. The cam 20 has a pair of lobes 28 each disposed adjacent a rollback contact surface 32. The radiused relief seen in the interior of the rollback 30 allows the cam 20 to rotate freely, without either lobe 28 contacting the rollback 30 when said rollback is laterally displaced with respect to the latch 40 as seen in FIG. 8. A displacement rod 37, which is substantially parallel the spindle 10, facilitates this lateral displacement with respect to the latch 40.

FIG. 4 illustrates a cross sectional view of what is intended to represent the interior hardware and a threaded, flatted, free spindle end 14 associated with a push/pull latch assembly in accordance with the principles relating to the present invention. The interior knob 16 is tapped in correspondence to the threading given a length of the free end 14 of the spindle 10. The flats given a length of the spindle 10 adjacent the threading match the apposed parallel flat faces, ie. interior flats, given a splined bushing 73, also illustrated in a plain top view in FIG. 5. As seen in FIG. 6, the interior cover plate 71 possesses a central splined bore 72 which is congruent to the splined bushing 73. Because the only motion required to operate said push/pull latch assembly is the linear spindle travel 12, a tapped interior knob 16 can be threaded onto the spindle free end 14. This feature novel to push/pull operation may be exploited in many diverse abilities.

It is also considered, however, that the spindle 10, having had the helix 11 rotated through the cam aperture 21 which has a particular rotational sense corresponding to the extended latch 40 position, effects a certain rotational orientation to the spindle 10 which it is desirable to maintain, undisturbed. Therefore, it is considered desirable, separately but particularly in conjunction with use of a tapped interior knob 16 and threaded free spindle end 14, to fix the rotational orientation of the spindle 10 in correspondence with the neutral cam 20 disposition rotationally.

Milling or otherwise effecting a pair of opposed flats upon the spindle 10 engaged by a congruently shaped aperture such as most clearly seen in FIG. 5 is considered the simplest and therefore best example of fixing the spindle 10 rotationally. The splined bushing 73 must, however, be fed into the splined bore 72 of the interior face plate 71 after said plate has been secured in position upon the closure and the spindle 10 fed through the entire assembly. As depicted in FIGS. 4–6, the splined bushing 73 is fitted to the flats upon the spindle 10 which extends through the interior cover plate 71, including the extended sleeve of the same, approximately as far as indicated in the parallel juxtaposition of the spindle 10 and the cover plate 71 depicted in FIG. 4. Thus aligned rotationally, the splined bushing is tamped, with an appropriate tool, into engagement with the splined interior bore 72. The coil spring 62 is next positioned as shown and the tapped knob 16 is threaded onto the now rotationally fixed spindle free end 14.

Figure 9:
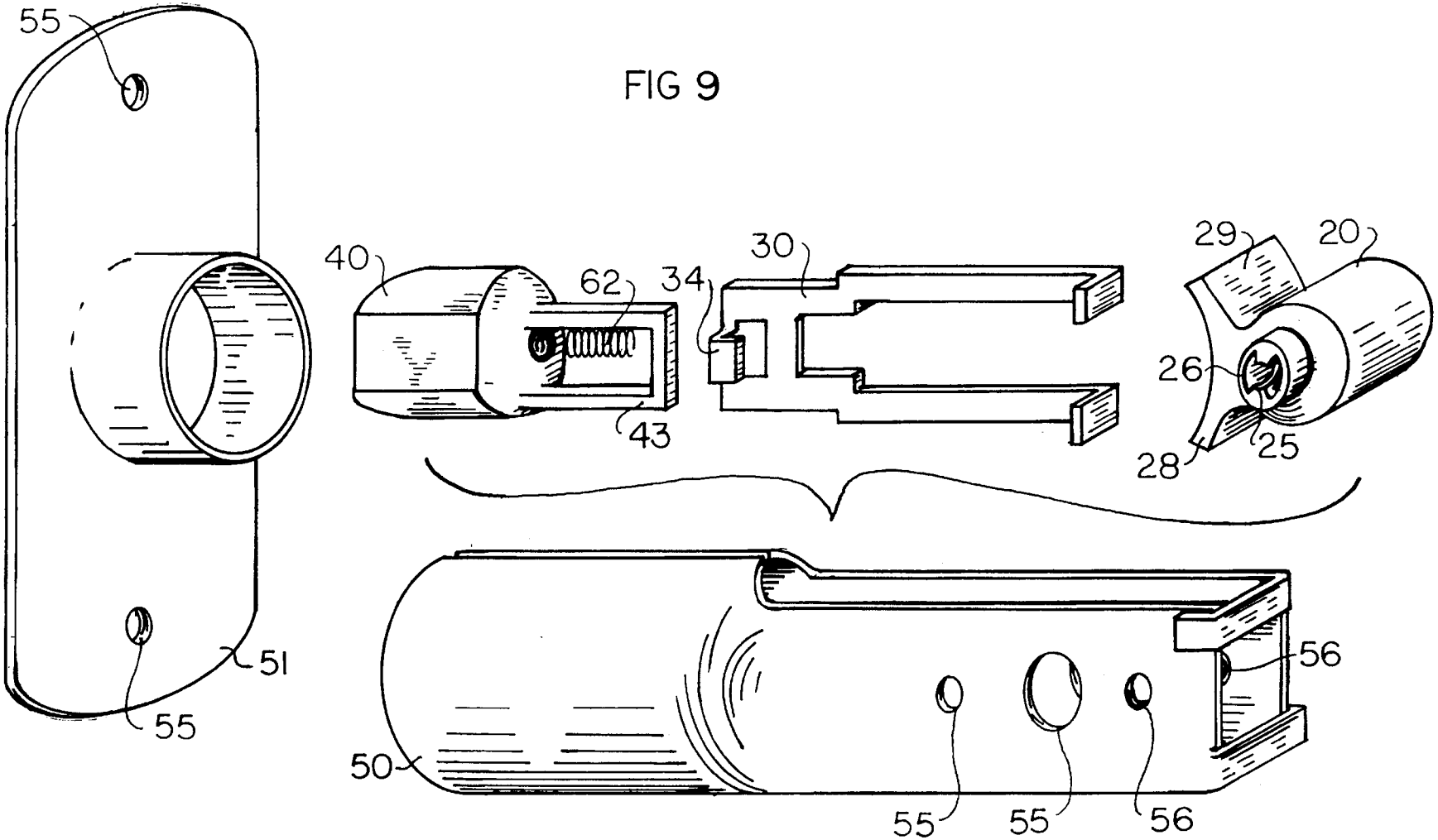
FIG. 9 is an explosion view of a push/pull latch assembly in accordance with the principles relating to the present invention illustrating a tubular frame, separate face plate, latch, coil spring, separate hooked rollback and twin lobed cam with helical teeth.

FIGS. 9 & 10 illustrate installation of a latch assembly in accordance with the principles relating to the present invention. As depicted in FIG. 9, the cam 20 has two opposed reduced diameters held by the two opposed large smooth apertures 55 in the frame 50 which also contains the rollback 30 and the latch 40. This latch assembly, without the spindle 10, typically is inserted into a cavity in the edge of a door possessing a generally rectangular aperture facing the jamb when aligned with the same as depicted in FIG. 10. This is common practice and well known. Typically, two screws passed through the smooth apertures 55 are used to fasten a face plate 51. The principal difference between installation of a conventional latch assembly with a spindle possessing a square cross section and installation of a latch assembly in accordance with the principles relating to the present invention involves the longitudinal displacement of the spindle through the cam aperture 21; the spindle must be rotated about its longitudinal axis as it is fed through the cam for the length of the helix 11.

The latch assembly and related hardware depicted in FIGS. 9 & 10 represents the best manner of making and using an embodiment in accordance with the principles relating to the present invention in particular regard to installation. One spindle 10 end is fixedly attached to what is considered the exterior knob 17. An assembled unit comprising the equivalent of the face plate 51, the frame 50 containing the latch 40, spring means, rollback 30 and cam 20 in operational engagement, is inserted into the typical cavity, and is fastened to the edge of the closure. With reference now to FIG. 10, the exterior cover plate 70, which, in this depiction possesses two tapped bore stanchions 76, is inserted through the open hole in the door, inserting the end of each said stanchion 76 through a smooth bore 55 of the frame 50. FIG. 9 depicts one such smooth aperture 55 and a tapped aperture 56, one on either side of the large smooth aperture 55 that holds the cam 20.

The tapped aperture 56 and bolt 77 provide longitudinal stability to the rearward portion of the frame 50 and the assembly held therein. This depicts a variation from the hardware depicted in FIG. 10 wherein each bolt 77 engages the tapped bore of one of the two stanchions 76, after the exterior cover plate 70 and the interior cover plate 71 have been positioned and aligned with one another. FIG. 10 also depicts four stabilizing bushings or spacers 74, one pair fitted upon the pair of stanchions 76 prior insertion through the smooth apertures 55 of the frame and the other two after this insertion but prior alignment of the interior cover plate 71 and threading of the bolts 77 into the tapped bores of the stanchions 76. The stanchions 76, along with the smooth holes through interior cover plate 71 are typically expected to be aligned horizontally and are depicted as vertically aligned in FIG. 10 simply to show both stanchions 76, one of which would be obscured in a horizontal depiction.

It is next considered desirable to pass the free end of the spindle through the open bore of the exterior cover plate 70 and through the cam aperture 21 from the exterior side of the closure as indicated in FIG. 10. It is intended that the fixed knob 17 end be that which effects retraction of the latch by pulling. The necessary travel 12 is hidden by the overlapping of two sleeves, one, an interior sleeve, extending from the knob, the other, an exterior sleeve extending outward from the exterior cover plate 70. A bushing placed between the two will facilitate a reduction of friction. Hence the entire exterior hardware assembly is without exposed connections and may be fit in place all at once.

From the interior side of the closure, the interior knob 16, including an extension comprising a spring loaded cylinder, is threaded onto the free spindle end 14, until the resistance of the spring loaded cylinder is felt and the entire latch assembly is tight. The exterior knob 17 butts against the exterior cover plate 70 which is flush to the exterior face of the closure. The interior knob 16 is extended by the spring loaded cylinder and any variation in the thickness of the door on the interior side is taken up by the threading of the interior knob onto the spindle 10. The spindle 10 depicted in FIG. 10 has a threaded free end 14 but lacks the flats depicted in FIG. 4. Similarly, there are is no splined bushing 73 depicted in FIG. 10 although there is a set screw 78 depicted which may be tightened against the spindle 10 after assembly in order to resist rotation of the tapped knob 16 upon the threaded end 14 of the spindle 10 as discussed above. It is recommended that bushings, splined or otherwise, be employed at either end of the spindle 10, preferably interior to a sleeve extension of the cover plates 70, 71. Other details in construction will be within the range of one skilled in the art.

The foregoing is intended to express what is considered the best manner of making and using an embodiment in accordance with the principles relating to the present invention including an indication of the variations and options considered desirable within the scope of said principles and to fully explain said invention in view of said principles frequently with the aid of examples.

It is understood that the foregoing is not restrictive in any manner to the intellectual property secured by granting of Letters Patent for which I hereby claim:

1. A push/pull latch assembly, intended for use in conjunction with associated hardware as a closure fastener, said push pull latch assembly comprising:

a spindle having a longitudinal axis and two opposed ends, a cam possessing at least one lobe and a through aperture, a rollback, a latch and a frame possessing a front face;

said spindle possessing a helix projecting radially from a uniform cross-sectioned portion and constituted by a helically formed portion medial to said ends comprised of arcuate surfaces;

said cam through aperture possessing a central axis and comprised of surfaces congruent said arcuate surfaces of said spindle helix;

said cam being held by said frame positioned along said spindle helix and in a rotatable disposition with respect to said central axis further being held substantially stationary with respect to linear displacement along said central axis;

said latch being held in a slidable disposition by and along a length of said frame substantially perpendicular said central axis of said cam through aperture;

said rollback being held in said frame such that rotation of said cam causes one said cam lobe to contact a surface of said rollback which, in reaction to said contact with said cam lobe and in tensile connection with said latch, translates said cam rotation into a linear displacement of said latch;

said spindle being disposed such that said longitudinal axis is substantially co-linear said central axis of said cam through aperture and said helix is in engagement with said congruent surfaces comprising said cam aperture, said spindle further being capable of linear displacement along a given distance of said longitudinal axis, hereinafter known as spindle travel;

the engagement of said spindle helix and said cam aperture translating said spindle travel into rotation of said cam which causes through said contact with said rollback said linear displacement of said latch sufficient to retract said latch from an extended position with respect to said front face of the frame to a position substantially flush with said front face.

2. The push/pull latch assembly of claim 1 wherein said latch and said rollback are comprised of a single member.

3. The push/pull latch assembly of claim 1 further possessing spring means biasing said latch into an extended position.

4. The push/pull latch assembly of claim 1 further possessing spring means biasing said spindle into a neutral position corresponding to the condition of said latch being in said extended position.

5. The push/pull latch assembly of claim 1 further possessing two positive stops limiting said spindle travel.

6. The push/pull latch assembly of claim 1 further possessing means of locking said latch in the extended position comprising the interposition of a member whereby said spindle travel is prevented.

7. The push/pull latch assembly of claim 1 further possessing means of locking said latch in the extended position comprising the disengagement of two members necessarily engaged to effect retraction of said latch by displacement of said spindle.

8. The push/pull latch assembly of claim 7 wherein said means of locking said latch in the extended position comprises the disengagement of said rollback from said cam such that said spindle travel effects rotation of said cam and each said cam lobe rotates freely without contacting said rollback.

9. The push/pull latch assembly of claim 1 further including a knob attached to each said spindle end.

10. The push/pull latch assembly of claim 9 wherein one said knob is fixedly attached to one said spindle end.

11. The push/pull latch assembly of claim 9 wherein one said spindle end is threaded and one said knob is tapped in correspondence with said threading.

12. The push/pull latch assembly of claim 1 further possessing means of preventing rotation of said spindle comprising congruently apposed longitudinal features in said associated hardware.

13. The push/pull latch assembly of claim 12 wherein said spindle further possesses at least one pair of opposed flats fit between apposed parallel flat faces of an externally splined bushing utilized in conjunction with an interior cover plate possessing a central bore internally splined in congruence with said externally splined bushing.

14. The push/pull latch assembly of claim 12 wherein said associated hardware includes an interior cover plate and a knob, said interior cover plate possessing an extended sleeve and said knob possessing an extended sleeve, one said sleeve overlapping the other said sleeve longitudinally, one sleeve further possessing a projection which slidably engages a congruent cavity in the other said sleeve.

15. The push/pull latch assembly of claim 1 wherein said cam possesses two cam lobes, one lobe disposed to effect contact with said rollback in one directional rotation of said cam, the other said lobe disposed to effect contact with said rollback in the other directional rotation of said cam.

16. The push/pull latch assembly of claim 15 utilized in conjunction with associated hardware including an interior cover plate, an exterior cover plate, an interior knob and an exterior knob further possessing spring means biasing said spindle into said neutral position corresponding to an extended latch positioning such that said exterior knob is biased inward towards said exterior cover plate, the interior knob is biased outward from said interior cover plate and said spindle travel is effected by pushing upon said interior knob and by pulling upon said exterior knob.

17. The push/pull latch assembly utilized in conjunction with said associated hardware of claim 16 wherein said interior cover plate possesses at least one smooth aperture and said frame possesses at least one tapped aperture into which a bolt passed through said smooth aperture in said exterior cover plate may be threaded.

18. The push/pull latch assembly utilized in conjunction with said associated hardware of claim 16 wherein said exterior face plate possesses at least one stanchion extending substantially perpendicularly from the back of said exterior cover plate and said frame possesses at least one smooth aperture through which said stanchion may be passed.

19. The push/pull latch assembly utilized in conjunction with said associated hardware of claim 18 wherein at least one said stanchion extending from said exterior cover plate possesses a tapped bore.

20. The push/pull latch assembly utilized in conjunction with said associated hardware of claim 19 further including at least one pair of spacers functioning as stabilizing bushings around at least one said stanchion, one said spacer being positioned during installation between said exterior cover plate from which the stanchion extends and the frame of the latch assembly, the other spacer being positioned on the portion of the stanchion extending through said latch assembly between said interior cover plate and said frame.

* * * * *